United States Patent [19]

Krob et al.

[11] Patent Number: 4,533,155

[45] Date of Patent: Aug. 6, 1985

[54] SAFETY SKI BINDING

[75] Inventors: Erwin Krob; Helmut Bauer, both of Vienna, Austria

[73] Assignee: TMC Corporation, Baar, Switzerland

[21] Appl. No.: 438,549

[22] Filed: Nov. 1, 1982

[30] Foreign Application Priority Data

Nov. 5, 1981 [AT] Austria ..... 4743/81

[51] Int. Cl.[3] ..... A63C 9/085

[52] U.S. Cl. ..... 280/628

[58] Field of Search ..... 280/628, 629, 630, 632, 280/631

[56] References Cited

U.S. PATENT DOCUMENTS

| | | | |
|---|---|---|---|
| 3,610,650 | 10/1971 | Korger | 280/628 |
| 3,649,037 | 3/1972 | Vouthier | 280/628 |
| 3,876,219 | 4/1975 | Smolka et al. | 280/628 |
| 4,421,341 | 12/1983 | Krob et al. | 280/628 |

FOREIGN PATENT DOCUMENTS

| | | | |
|---|---|---|---|
| 338151 | 8/1977 | Austria | 280/628 |
| 2347746 | 5/1974 | Fed. Rep. of Germany | 280/628 |
| 2429608 | 1/1976 | Fed. Rep. of Germany | 280/628 |

*Primary Examiner*—David M. Mitchell

*Attorney, Agent, or Firm*—Flynn, Thiel, Boutell & Tanis

[57] ABSTRACT

A safety ski binding part includes a base plate having a roller supported thereon for rotation about a generally longitudinally extending axis, and a sole holder supported on the base plate for pivotal movement around a vertical axis and a transverse horizontal axis, the sole holder having a shoulder thereon. A lever supported on the base plate for pivotal movement about a transverse axis has a nose engageable with the shoulder and a transversely extending cam surface engageable with the roller. A release spring biases the lever in a direction urging the nose into engagement with the shoulder and urging the cam into engagement with the roller.

8 Claims, 10 Drawing Figures

SAFETY SKI BINDING

FIELD OF THE INVENTION

This invention relates to a safety ski binding part.

BACKGROUND OF THE INVENTION

A known safety ski binding part includes a sole holder which can be pivoted about a transverse axis and a vertical axis and is held in a position in which it holds a ski shoe by a locking mechanism which yields after predetermined elevational or lateral release forces are exceeded and in which the effective release force is reduced with an increasing change of the direction from the vertical of the forces applied, preferably to a pre-given limit. Two locking parts of the locking mechanism are provided at separated locations on a locking part carrier which is constructed as a swingable lever. One complementary locking part is provided on the rear area of the sole holder and the other complementary locking part is provided on a structural part which is fixed with respect to the ski. The lever is pivotally supported on a holding axis which extends parallel to the transverse axis, which holding axis is in turn arranged in a support member which is pivotal about a pivot pin which forms the vertical axis and is anchored in a base plate, if desired against the force of a return spring, and which lever has on its side which does not face the two locking parts thereon a control surface which is biased by a release spring.

A safety binding of the abovementioned type is described in Austrian Pat. No. 294 645 (corresponds to U.S. Pat. No. 3,610,650). In this conventional design, which relates both to a front jaw and also to a heel holder, it is disadvantageous that a transverse movement of the binding will not only lead to a release of the transverse locking device, but at the same time permit play in the lift locking device. This is disadvantageous in the case of the use of this conventional ski binding as a heel holder, because a heel holder lift locking is supposed to be somewhat insensitive to purely lateral forces in order to assure a securer ski guiding.

A similar safety ski binding has become known from German OS No. 18 06 780. (corresponds to U.S. Pat. No. 3,620,545). In this binding, the two locking devices for the elevational and lateral release forces are defined by a common locking member and by a locking part carrier which cooperates with this locking member and is effective both for the elevational and also for the lateral release. The carrier has thereby control surfaces which are decisive for the elevational and lateral release. A disadvantage of this conventional design lies in both the locking element and also the carrier being responsible for two release devices. From this it follows that, in particular due to structural conditions, compromises must be accepted. Practical experience has shown that while these compromises were adequate, they were not entirely satisfactory, and for a product which actually was sold on the market, a further cam was created for controlling the lateral release, which cam is provided between the base plate and the housing of the ski binding. This embodiment in turn has the disadvantage that snow, ice or the like can accumulate between the base plate and housing, which can result in the release operation being erratic.

It is also known from FIG. 6 of Austrian Pat. No. 338 151 to arrange a swingably supported lever between the two locking elements, which lever is loaded on its back-side by a spring-loaded slide member and holds this slide member in position with its portion which faces the sole down-holding means. The sole holder can be swung up about an axis which extends transversely with respect to the longitudinal direction of the ski, which axis is arranged above the slide member and approximately at the level of the support surface of the sole holder. The vertical axis about which the sole holder is pivotal during lateral loads is formed by two semiaxles or stub shafts which in turn are supported on the lever or the sole holder which is supported on the transverse axis and which can be swung upwardly. This has the result that the transverse axis, upon the occurrence of lateral forces, in the end effect is stressed by thrust forces which must be absorbed by the two bearings of such axis, which can cause the axles to easily be worn out. This circumstance would result in an undesired wobbling of the sole holder.

Austrian Pat. No. 305 843 furthermore suggests creating the second locking arrangement between the sole holder and a locking member which is arranged on the ski and is approximately cam-plate-shaped. Even though this design has proven itself in practice, it is somewhat disadvantageous, because stepping into the released binding with difficult ground conditions requires some skill.

It is furthermore known from Austrian Pat. No. 327 759 to support the release spring by means of a spring cage in the release lever and to create in this manner a unit which is pivotal about a common swivel axis. This solution permits a swinging up of the heel holder, but does not permit a release of the same in the direction of forces which act diagonally in the space and cause twisting falls.

Further, German OS No. 28 38 904 describes a solution which has been created substantially by combining the features of the two lastmentioned Austrian patents and which also contains their disadvantages. The conventional designs have furthermore the disadvantage that, with an increasing lateral release, the lateral holding mechanism becomes increasingly sensitive to wobbling, which can cause the ski guiding, if a release should not yet take place, to become inexact.

A purpose of the invention is to bring help here and to provide a safety ski binding of the abovementioned type in which the lever is supported on the complementary locking part which is provided on the ski-fixed structural part.

SUMMARY OF THE INVENTION

This purpose is attained inventively by the structural part which is fixed with respect to the ski having a locking bolt, if desired with a roller, which extends longitudinally of the ski and is secured on at least one abutment formed by a bent-up part of the base plate, on bearing points, on a separate binding-fixed abutment or on the like, and either the locking bolt itself or the roller being a locking part. A cam which forms a locking part on the lever extends transversely of the longitudinal axis of the ski and has a locking recess for effecting a laterally blocked receiving of the associated locking part for downhill skiing, and is equipped adjacent the locking recess with curve sections extending in both directions toward the two side edges of the ski for controlling twisting fall releases.

The inventive measure assures that the lever can in each position be supported with substantially no clearances on the structural part which can be fixed relative to the ski, so that on one hand, the forces exerted on the lever can be taken over frictionally by such structural part, and on the other hand, the release operation can be controlled by selection of the shapes of the surfaces on the lever and on the structural part. With this, the designer has available to him a greater selection with respect to determining the release characteristics than has been the case in conventional designs. Furthermore, the sole holder is centered in the entire elasticity range and is held in the center position for stepping in.

A particularly advantageous embodiment of the invention includes the longitudinal axis of the locking bolt being inclined to the upper side of the ski at an acute angle, which angle opens toward the tip of the ski, and the roller which is provided on the locking bolt being constructed cylindrically or frusto-conically. The surface of the roller serves as a control surface for the cam of the lever and can engage it along at least a line and, preferably, a surfacesection. This measure makes it possible for the designer to determine the control of the release for dangerous twisting falls in correspondence with the respective requirements.

A further development, particularly of this inventive thought, includes the cam of the lever, viewed in the downhill skiing position, engaging the front portion of the cylindrical roller and, viewed in the swivelled position of the lever up to or prior to a release, engaging also the rear portion of the roller. In this manner, by determining the length of the roller, the control of the release operation which occurs in a diagonal direction can be determined in an advantageous manner in connection with the development of the cam.

A different thought of the invention includes the cam of the lever having an inclination, the angle of which is equal to the angle of the cone of the frusto-conical roller, and by the roller being biased by a spring, for example, a helical spring which surrounds the locking bolt, in a direction toward the lever. This measure assures that, in every position of the lever, the engagement of the cam and roller is such as to reduce the surface pressure and thus the created friction.

A different thought of the invention is characterized by the lever being constructed in two parts, one lever part, being pivotal about the locking lever axis and carrying a locking part which engages the sole holder, and the other lever part pivotal relative to the first lever part and carrying the second locking part of the lever. The split design of the lever increases its swivelling capability, which gives the designer greater freedom with respect to determining the control of the release operation. Furthermore, the angle of the lever can be optimized.

According to an advantageous development of this thought of the invention, the first lever part has a recess in which the second lever part is supported pivotally about the swivel axis of the first lever part, the second lever part being supported resiliently relative to the first lever part by means of a spring, preferably an adjustable compression spring. This measure makes it possible to absorb undesirably high frictional forces created between the roller and cam by means of the further spring. Also, unevennesses of the ground transmits momentary impacts through the ski and onto the ski binding, which can in this manner be absorbed without causing an undesired release operation. The adjustability of the strength of the spring by means of an adjusting screw serves to adjust the spring strength to the respective requirements, which, for example are necessary due to the skiing capability of the skier or due to skiing conditions.

A modification of the split design of the lever inventively includes the second lever part being supported by its cam on the roller from above, and in the cam, viewed in a front view, being inclined, so that the second lever part is swingable together with the first lever part. Also, in this case, the capability of swinging the lever is increased, whereby here the first lever part is substantially simplified in its construction compared with earlier arrangements. The two-part development of the lever is sufficiently compensated for by the greater capability for determining the characteristics of the release operation.

BRIEF DESCRIPTION OF THE DRAWINGS

Further characteristics, advantages and details of the invention will now be described in greater detail in connection with the drawings, which illustrate several exemplary embodiments.

In the drawings.

DETAILED DESCRIPTION

Figure 1:
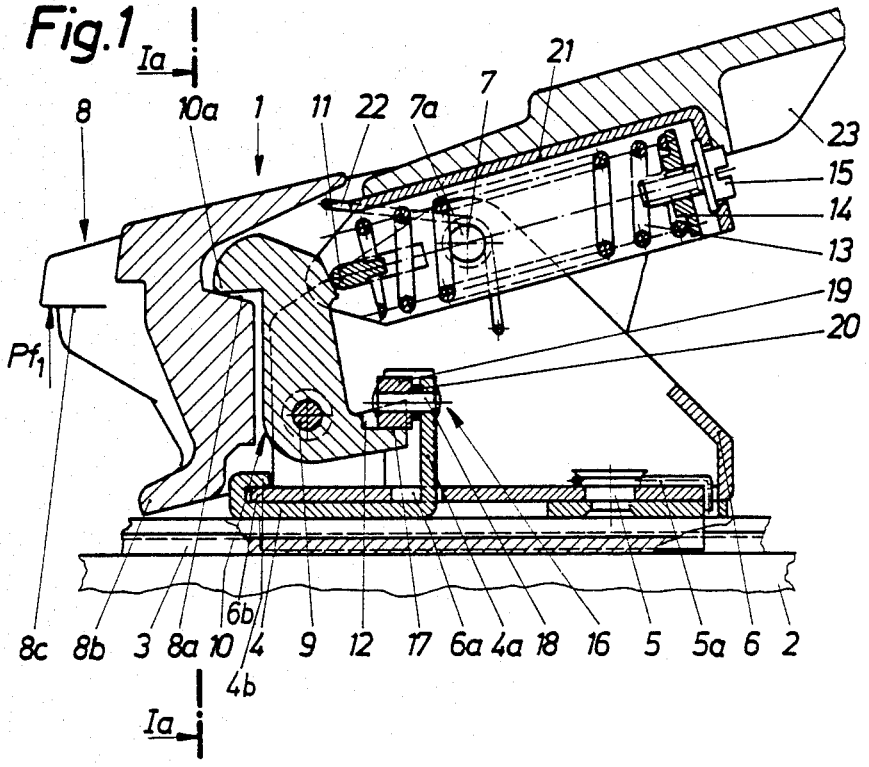
FIG. 1 is a longitudinal sectional view of a first exemplary embodiment of an inventive safety binding part in a downhill skiing position taken along the line I—I of FIG. 2, including a locking part defined by a cylindrical roller on a bolt which lies in a plane parallel to the upper side of the ski.
Figure 2:
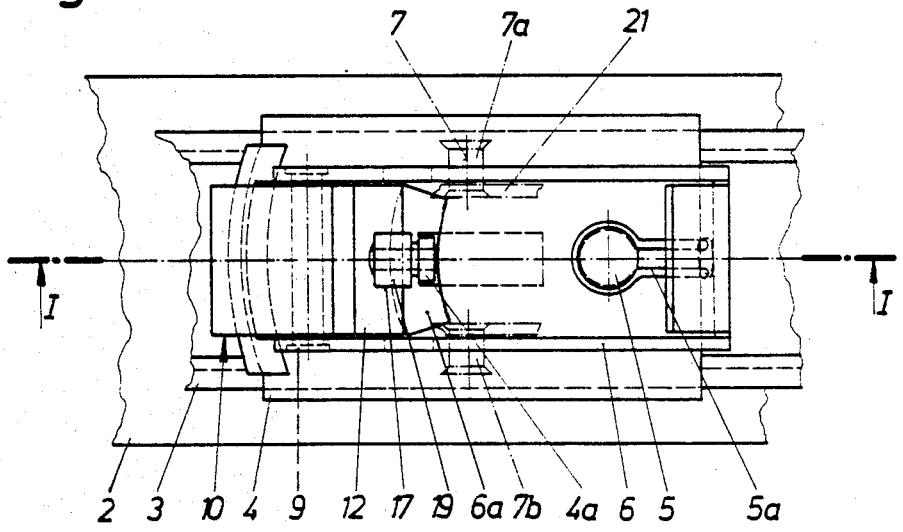
FIG. 2 is a top view of the binding part of FIG. 1 with the release lever and release spring omitted.

FIGS. 1 and 2 illustrate a safety ski binding part which as a whole is identified as a heel holder 1. The heel holder 1 is longitudinally movably supported on a guide rail 3 which in turn is secured on the upper side of a ski 2 in a conventional manner, for example by not illustrated screws. To adjust the binding to different length ski shoes, a base plate 4 of the heel holder 1 can move relative to the guide rail 3 in the direction of the longitudinal axis of the ski and can be releasably secured in a conventional manner in any desired position. The structure and operation of the longitudinal adjustment mechanism is conventional and not a part of the subject matter of the present invention, and is therefore not illustrated or described in detail.

A vertical axle which is constructed as a pivot pin 5 is secured in the base plate 4, about which vertical axle a support member 6 of the heel holder 1 is pivotally supported and is preferably biased by a return spring 5*a*. The return spring 5*a* assures that the heel holder 1, after a swivelling release which occurs at least partially in a horizontal direction, is returned automatically to its center position (its downhill skiing position).

The support member 6 has in its upper region a swivel axle 7 which extends transversely to the longitudinal axis of the ski and parallel to the upper side of the ski 2. The axle 7 is preferably formed by two swivel pins 7*a* and 7*b* (FIG. 2). The swivel axle 7 pivotally supports a sole holder 8. A further holding axle 9 which is parallel to the swivel axle 7 is arranged approximately in the center region of the support member 6, which holding axle 9 pivotally supports a lever 10. A release lever 23 is also supported on the swivel pins 7*a* and 7*b* (FIG. 1), in which release lever is provided a release spring 13 which biases the lever 10. Adjustment of the effective force of the release spring 13 is effected in a conventional manner by means of an adjusting screw 15. The release spring 13 is supported with one of its ends on the inner wall of a spring abutment 14 which threadedly engages the adjusting screw 15, and its other end on a slide member 11 which is movably guided in slots provided in a spring cage 21 and engages the lever 10.

The lever 10 carries locking parts of both a locking mechanism which yieldably resists elevational release forces and also for a locking mechanism which yieldably resists lateral release forces. To lock against a swinging up, a locking part which is a nose 10*a* is provided on the lever 10 and engages from the rear a complementary locking part or shoulder 8*a* provided on the sole holder 8 (see in particular FIG. 3). The locking mechanism which is active against a swinging in a horizontal direction is formed by a locking part which is a cam surface 12 on the lever 10, will be described in greater detail later, and engages a control surface 17 of a structural part 16 which can be fixed on the base plate 4, which control surface 17 will also be described in detail later.

The structural part 16 is formed in the present case by a rivet or locking bolt 18 which rotatably supports a roller 19 on an abutment 4*a*. The roller 19 is thus secured against movement in the longitudinal direction of the locking bolt 18, preferably with the interpositioning of a washer 20. The control surface 17 is provided on the surface of the roller 19, which is cylindrical in this embodiment.

The abutment 4*a* is punched out of the material of the base plate 4 and is then bent upwardly. The abutment 4*a* extends through a recess or opening 6*a* provided in support member 6. Since the support member 6 is, in its installed position, held by a rearwardly bent guide edge 4*b* of the base plate 4, the recess 6*a* of the support member 6 must be of sufficient size to permit installation of the support member 6. In connection with this installation, the recess 6*a* of a support member 6 is first placed over the abutment 4*a*, the front edge 6*b* of the support member 6 is then moved under the guide edge 4*b* of the base plate 4, the support member 6 is pressed forwardly, and subsequently the longitudinal position of the support member 6 on the base plate 4 is fixed by means of the pivot pin 5.

Figure 1A:
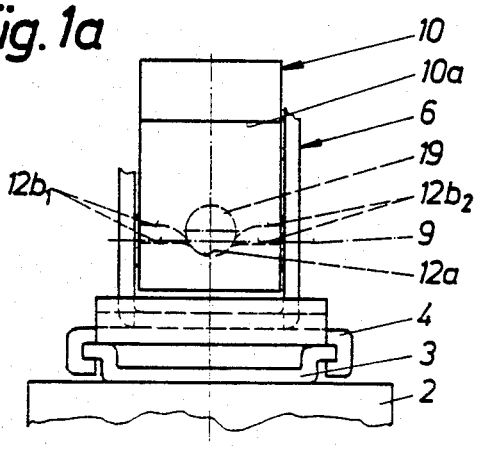
FIG. 1*a* is a sectional view taken along the line Ia—Ia of FIG. 1, but with the sole down-holding means, the release lever and the release spring omitted.

The cam 12 which is provided on the lever 10 has a design or shape which can best be seen in FIG. 1*a*. It can there be recognized that, in the downhill skiing position of the heel holder 1, the roller 19 lies in a locking recess 12*a* of the cam 12, which assures a wobble-free control in the downhill skiing position of the heel holder 1. Adjacent the locking recess 12*a*, curve sections $12b_1$ and $12b_2$ can be recognized on respective sides thereof, which curve sections extend generally toward the respective sides of the ski 2 and, according to their shape, effect the desired control and release during twisting falls. This mode of operation will be described in greater detail later on.

Figure 3:
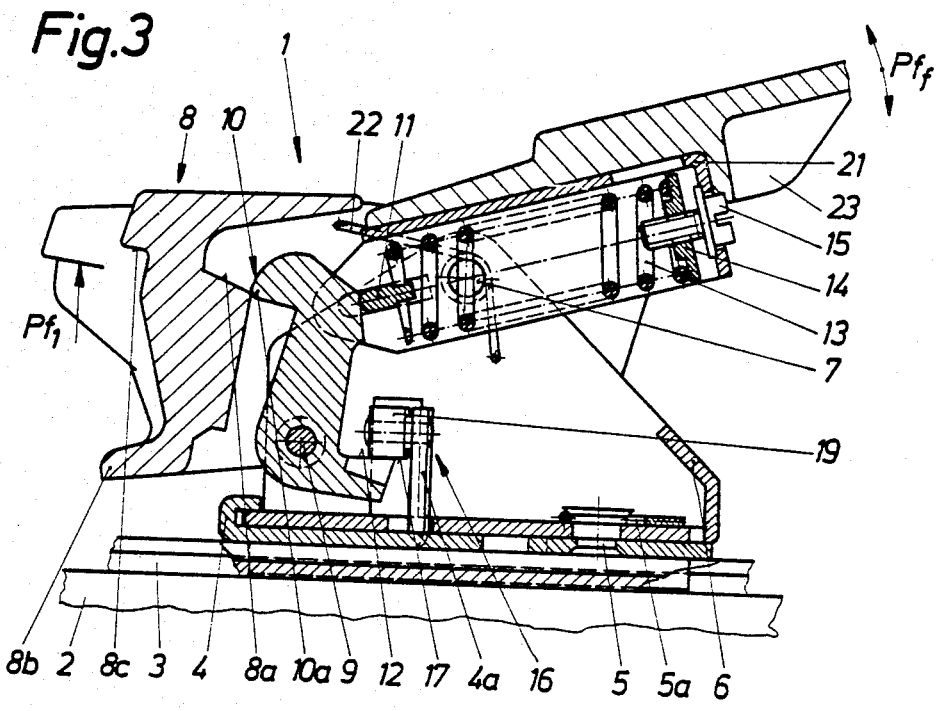
FIG. 3 is a longitudinal sectional view taken along the line III—III of FIG. 4 showing the ski binding part of FIG. 1 during a release operation.
Figure 4:
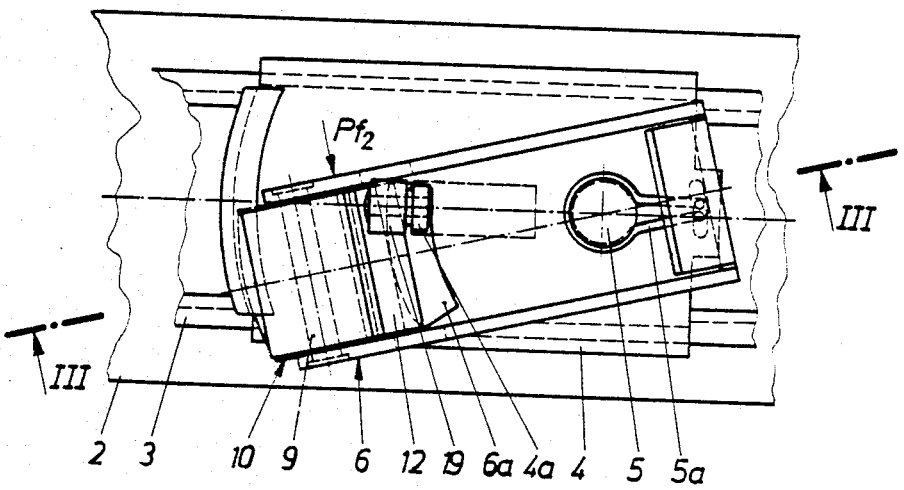
FIG. 4 is a top view of the binding part of FIG. 1 during a release operation.

As a comparison of FIGS. 1 and 2 with FIGS. 3 and 4 shows, it is assured through the abovedescribed design of the structural part 16 and the cam 12 that the lever 10 is supported on the structural part 16 in each of its operational positions so that, during a swinging of the lever 10 in a horizontal direction (caused by the occurrence of forces both in the vertical and also in the horizontal direction), the sole holder 8 is firmly controlled until its release from the springloaded lever 10, so that a wobbling of the sole holder 8 or the heel holder 1 does not occur either in the downhill skiing position or before the limit of elasticity is reached during a release operation.

In order to keep the heel holder 1, after a voluntary or automatic release, ready for a stepping in, an opening spring 22 is provided, which is constructed for example as a torsion spring arranged on the swivel axle 7.

The heel holder 1 of the invention operates as follows. In the position according to FIGS. 1 and 2, a ski shoe (not illustrated) is pressed by the heel holder 1 in a conventional manner against a front jaw, whereby the heel of such ski shoe is held in the usual manner between the spur 8*b* and the down-holding member 8*c* of the sole holder. If vertical forces now act onto the ski shoe, then the shoe presses against the down-holding member 8*c*, as is indicated in FIG. 1 by the arrow $Pf_1$, through which the sole holder 8 is moved and causes the lever 10 to pivot clockwise against the force of the release spring 13 about the holding axle 9. At the same time, the cam 12 of the lever 10 moves away from the control surface 17 of the structural part 16, whereby the engagement between the cam 12 and the roller 19 may remain, depending on the level of the locking recess 12*a* (see FIGS. 1*a* and 5*a*). The heel holder 1 holds the ski shoe until the nose 10*a* of the lever 10 barely engages the counter-notch 8*a* of the sole holder 8. This position is not illustrated by itself in the drawing, but this support of the nose 10*a* of the lever 10 on the locking part 8*a* of the sole holder 8 can be taken in principle from FIG. 3. If the force $Pf_1$ which acts on the ski shoe terminates at or before the position of engagement between the lever 10 and the sole holder 8 just described is reached, then the release spring 13 pivots the lever 10 counterclockwise in FIG. 1 and thus presses the sole holder 8 and the heel of the shoe back toward the upper side of the ski 2, and the skier thus remains in the binding. If, however, the force $Pf_1$ continues to be active, then the sole holder 8 eventually reaches a position in which the engagement between the nose 10*a* of the lever 10 and the complementary locking part 8*a* of the sole holder 8 ceases, and the sole holder 8 can then swing upwardly freely or with the assistance of the opening spring 22, which permits the ski shoe to be freed.

If vertical and horizontal forces act simultaneously onto the heel holder 1, which forces are designated in FIGS. 3 and 4 as $Pf_1$ and $Pf_2$, then they effect not only a pivoting of the lever 10 about its holding axis 9, as described earlier, but also pivot the support member 6 about the pivot pin 5. In the illustration according to FIG. 4 this pivoting occurred, viewed in the downhill skiing direction, to the skier's left. FIGS. 3 and 4 illustrate, as mentioned earlier, a position in which, when the forces which act on the ski shoe cease, the sole holder 8 can still be swung back to its position according to FIGS. 1 and 2, which includes a swinging back of the support member 6 to the position which corresponds with the downhill skiing position.

For a voluntary stepping out of or opening of the sole holder 8, the release lever 23 is manually operated. For this purpose the release lever 23 can, according to the double arrow $Pf_f$, be pivoted either downwardly or upwardly. It is known to construct the release lever to receive the end of a ski pole or a safety strap.

Pivoting the lever 23 moves the slide member 11 to a position in which it does not engage the lever 10 or engages it at a location nearer the axle 9, so that the lever 10 can be pivoted free of or substantially free of the force of the spring 13, thus facilitating the voluntary release.

In the exemplary embodiments according to FIGS. 5 to 8, those structural parts which are identical to the ones which have already been described in connection with FIGS. 1 to 4 are provided with the same reference numerals. Structural parts which are identical in function but differ in structure from those described in connection with FIGS. 1 to 4 are identified with similar reference numerals. Since these embodiments are substantially identical to the one already described in certain respects, some of the identical structure is omitted in the drawings and primarily the structural elements which are associated with the control lever are illustrated and described in detail. FIGS. 5 to 8 illustrate an embodiment of the ski binding part in a cross section similar to FIG. 1.

Figure 5A:
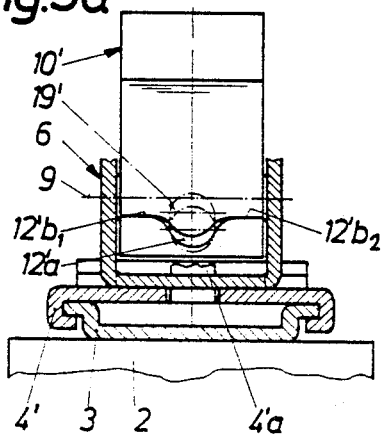
FIG. 5*a* is a sectional view taken along the line Va—Va of FIG. 5, but with the sole down-holding means, release lever, and release spring omitted.
Figure 5:
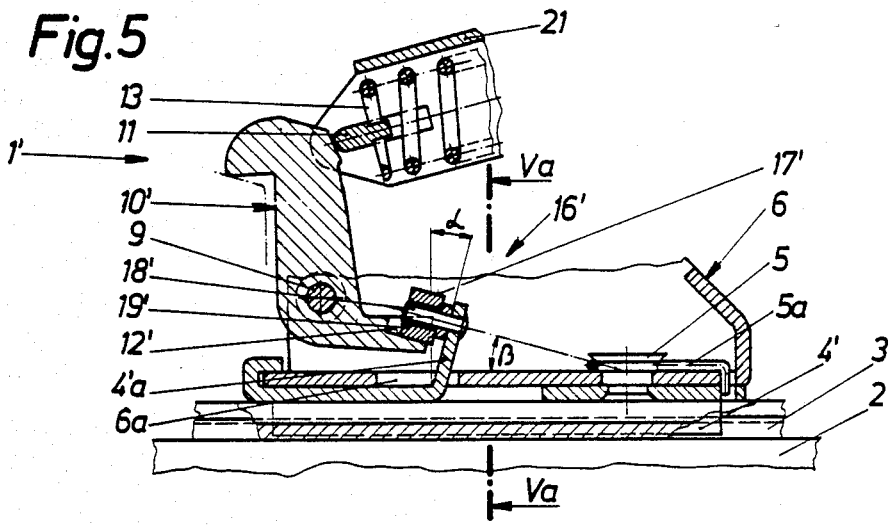
FIG. 5 is a fragmentary sectional side view of a second embodiment of the binding part of FIG. 1 in which the bolt with a cylindrical roller extends at an inclined angle with respect to the upper side of the ski.

In the embodiment according to FIG. 5, the design of the heel holder 1' with respect to the arrangement of its base plate 4*a* on the guide rail 3, which is secured on the upper side of the ski 2, corresponds with that already described. Here, too, the pivot pin 5 is provided in the base plate 4', on which pivot pin is pivotally supported the support member 6. The support member 6 is also biased by the return spring 5*a*. The lever 10' is pivotal about the holding axle 9 and the cam 12' on the lever 10' extends toward the upper side of the ski at an angle $\beta$. The structural part 16' which is secured on the base plate includes in the present case an abutment 4'*a* which extends upwardly at an incline through the recess 6*a* in the support member 6. The abutment 4'*a* extends at an angle $\alpha$ with respect to a plane which is normal to the base plate 4' and to the longitudinal axis of the ski 2. Thus, the longitudinal axis of the locking bolt 18 is arranged at the angle $\beta$ with respect to the upper side of the base plate 4'. Due to the geometry of this development, $\alpha$ theoretically equals $\beta$, but deviations can occur in practice. The roller 19' is also cylindrical here, whereby its control surface 17', which when viewed in cross section is indicated by two boundary lines, forms the angle $\beta$ with respect to the upper side of the base plate 4'. Due to this development, the surface of the cam 12' of the lever 10' also extends at an incline to the upper side of the base plate 4'. Attention must thereby be paid to the fact that, in different positions of the lever 10', various areas of the cam 12' must rest on the control surface 17' of the roller 19'. For this reason, the two curve sections 12'$b_1$ and 12'$b_2$ and also the locking recess 12'*a* define an inclined or twisted surface, as shown in FIG. 5*a*. Through this develoment of the lever 10', it is assured that in each position of the lever 10', the support of the cam 12' on the control surface 17' of the structural part 16' occurs along a surface section. This is advantageous in order to avoid a high surface pressure which produces undesirable frictional forces, as is the situation for example in the case of support along a line. The slightly more complicated development of this type of locking and the higher manufacturing costs connected therewith are justified by the more desirable friction ratios.

In other words, the surface of the cam 12' twists somewhat in the region of the locking recess 12'*a* in order to ensure, as in the embodiment of FIGS. 1 to 4, that in every operational position in which the cam 12' engages the roller 19', there is a line of engagement rather than a point of engagement therebetween. This means that, as the roller 19' rolls along the cam 12', the engagement therebetween will occur along a surface section of the cam 12', rather than a line.

The operation of the heel holder 1' should, in view of the description of the operation of the first exemplary embodiment, be clear to a person skilled in the art without further explanation. Therefore, an illustration and description of a release operation for the embodiment according to FIG. 5 is not given.

Figure 6:
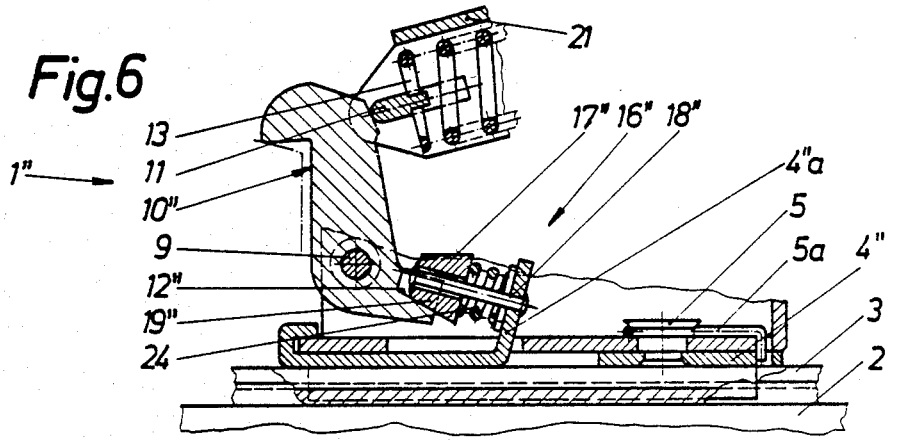
FIG. 6 is a fragmentary sectional side view of a third embodiment of the ski binding part of FIG. 1 in which a frusto-conical roller is provided on the bolt which is inclined to the upper side of the ski.

The exemplary embodiment according to FIG. 6 is similar to the one according to FIG. 5, but with the difference that a frusto-conical roller 19'' is arranged on the locking bolt 18'' of the structural part 16'', which roller is biased by a pressure spring 24 toward the lever 10''. This development of the structural part 16'' assures a support of the lever 10'' on the roller 19'' in every position of the lever 10'' along a surface section, as with the exemplary embodiment according to FIG. 5, yet permits the surface of the cam 12'' of the lever 10'' to be manufactured with a surface design extending parallel to the basis of the cam surface of the cam 12''. With this, a simpler manufacture of the surface of the cam 12'' than in the embodiment of FIG. 5 is possible.

Since according to this embodiment the roller 19'' can move by means of the pressure spring 24 in the direction of the longitudinal axis of the bolt 18'' momentary engaging portions of the lever 10'' and of the cam 12'' of the roller 19'' depend on the position of the lever 10''. In the position of the lever 10'' according to FIG. 6, which is the downhill skiing position, the cam 12'' engages the front part of the roller 19''. When the lever 10'' has swivelled but prior to a release, the cam 12'' engages the rear part of the roller 19'' too. This design is especially of interest concerning a so-called diagonal release movement in order to have a continuous engagement between the surface of the cam 12'' and the roller 19''.

The further operation and all the further comments which have been made in connection with the embodiment of FIG. 5 are also valid for this exemplary embodiment.

Figure 8:
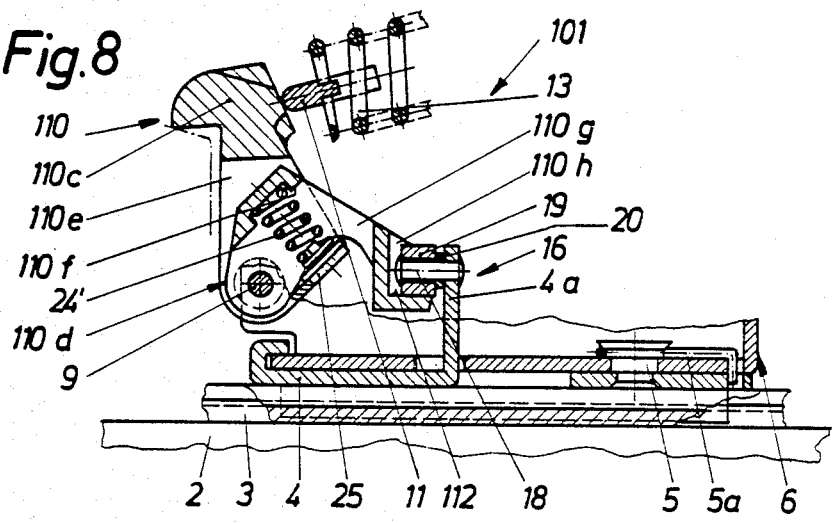
FIG. 8 is a fragmentary sectional side view of a fifth embodiment of the ski binding part of FIG. 1 in which a lever is constructed in two parts.
Figure 7:
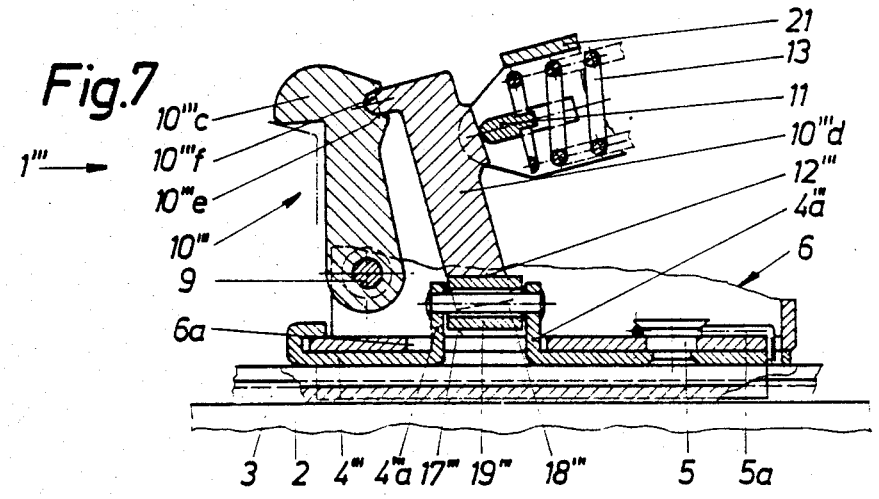
FIG. 7 is a fragmentary sectional side view of a fourth embodiment of the ski binding part of FIG. 1 in which a lever is constructed in two parts.

In the embodiments according to FIGS. 7 and 8, the levers 10''' and 110 are each designed in two parts. These two exemplary embodiments have in common that the two lever parts 10'''*c* and 10'''*d* or 110*c* and 110*d* are pivotal relative to one another. The two first lever parts 10'''*c* and 110*c* are, as in the previously described embodiments, pivotally supported on the holding axle 9. The two part levers 10''' and 110 are different, however, so that a separate description of each will be given hereinafter.

In the exemplary embodiment according to FIG. 7, the first lever part 10'''c is biased, through the interpositioned second lever part 10'''d, by the release spring 13. For this purpose, the first lever part 10'''c has on its area which faces the release spring 13 a recess 10'''e and the second lever part 10'''d a nose 10'''f. Recess 10'''e and nose 10'''f are in engagement with one another in every position of the heel holder 1'''.

The recess 10'''e and the nose 10'''f preferably have approximately semi-cylindrical surfaces which engage each other so that the lever parts 10'''c and 10'''d are effectively supported for pivotal movement with respect to each other.

In this exemplary embodiment, the structural part 16''' includes two upwardly bent abutments or bearing members 4'''a of the base plate 4''' which support the locking bolt 18'''. The locking bolt 18''' in this case extends through the two abutments 4'''a of the base plate 4''', and its longitudinal axis extends substantially parallel to the upper side of the base plate 4'''. A cylindrical roller 19''' can be recognized here, the control surface 17''' of which is engaged from above by a cam 12''' on the second lever part 10'''d. Since the second lever part 110'''d together with the first lever part 10'''c must carry out a swivelling movement in the vertical plane, the shape of the cam 12''' is similar to that of the cam 12' according to FIG. 5, but vertically inverted, since here the cam 12''' moves in a direction opposite of the cam 12' according to FIG. 5, namely, up rather than down. At any rate, it is also assured here that the support of the second lever part 10'''d on the control surface 17''' of the roller 10''' occurs along a surface section. The two abutments 4'''a are punched out of the base plate 4''' with outlines which are offset to one another, and are then bent upwardly. In this manner, the punched-out area of the base plate 4''', which is visible in the drawing, is sufficient to create both abutments 4'''a.

In the exemplary embodiment according to FIG. 8, the first lever part 110c has a recess, into which projects an end portion of the second lever part 110d. The second lever part 110d has a special design which can be seen in FIG. 8, and includes a portion 110f which is disposed in the recess 110e, pivotally supported on the swivel axle 9, and connected by a connection portion 110g to the portion 110h which carries the cam 12. The cam 12 and the structural part 16 correspond with the exemplary embodiment according to FIGS. 1 to 4, so a description thereof is not needed.

The second lever part 110d is biased relative to the first lever part 110c by an interpositioned compression spring 24'. The spring 24' can be changed in its initial tension by means of an adjusting screw 25. The adjusting screw 25 supports and threadedly engages a spring plate for one end of the pressure spring 24', while the other end of the pressure spring 24' is disposed in a separate recess of the second lever part 110d. By adjusting the force of the pressure spring 24', it is possible to adjust the initial tension between the two lever parts 110c and 110d. Through this measure, relatively small impacts which are transmitted by the ski during skiing onto the heel holder 101 are, so to speak, absorbed, so that no undesired release operations are initiated. Thus, the roller 19 remains in the locking recess of the cam 112.

The operation and all further comments made in connection with the embodiment according to FIG. 5 are also valid for the two exemplary embodiments according to FIGS. 7 and 8.

The invention is not limited to the illustrated exemplary embodiment. Further modifications, including the rearrangement of parts, are possible without leaving the scope of protection. For example, the release spring can also be supported directly in the release lever without the interpositioning of a cylindrical spring cage, whereby then the release lever must have suitable slots for the slidingly movable slide member. It is also conceivable to combine the disclosed arrangements with one another, for example, to support a frusto-conical roller on a locking bolt which extends parallel to the upper side of the ski.

Furthermore, the abutment can be manufactured as a separate structural element which is then secured on the base plate of the heel holder for example by welding or by means of rivets. Such a measure does require more work than the aforedescribed punch operation, but may possibly be advantageous, for example, where the base plate is not to be weakened. The manner of fastening such a structural element should be familiar to a man skilled in the art without further explanation.

The locking bolt can also be supported on the structural part which is fixable on the base plate without interpositioning a separate washer. In this case, the platelike formation is constructed in one piece with a bolt. However, it is also possible to support the riveted head of the bolt, for the purpose of a larger support area and with the interpositioning of a washer, on the mentioned structural part, or to design the head larger than illustrated in the drawing.

The inventively designed binding has in all embodiments the common advantage that the locking mechanism is extensively protected against external influences.

The embodiments of the invention in which an exclusive property or privilege is claimed are defined as follows:

1. In a safety ski binding which includes a sole holder which is pivotal about a transverse axis and a vertical axis and is held in a position in which it can releasably hold a ski shoe by a locking mechanism which yields only after a predetermined release force is exceeded, the magnitude of said predetermined release force decreasing as an angle between the direction of application thereof and a vertical reference increases, wherein first and second locking parts of said locking mechanism are provided at spaced locations on a pivotally supported lever, wherein a first complementary locking member which is cooperable with said first locking part is provided on a rear portion of said sole holder and a second complementary locking member which is cooperable with said second locking part is provided on a structural part which is fixed against movement with respect to the ski, and wherein said lever is supported for pivotal movement about a holding axle which extends parallel to said transverse axis and which is supported on a support member which is in turn pivotal about a pivot pin which defines said vertical axis and is anchored in a base plate, said lever having at a location remote from said first and second locking parts a control surface and said binding having a release spring and means for causing a biasing force from said release spring to be applied to said control surface, the improvement comprising wherein said structural part which is fixed against movement with respect to the ski includes a locking bolt and a roller rotatably supported thereon, said locking bolt extending approximately longitudinally of the ski and being supported by an abutment which is provided on said base plate, said locking bolt and roller being part of said second complementary locking member, and wherein said second locking part is an upwardly facing cam surface which is provided on said lever, which extends substantially transversely with respect to the longitudinal axis of the ski, which can engage an underside of said roller, which has a locking recess for receiving said roller and for preventing lateral movement thereof in a downhill skiing position of said binding, and which has adjacent and on each side of said locking recess a respective curve section which extends toward a respective side of the ski for controlling a release during a twisting fall.

2. The binding according to claim 1, wherein said locking bolt is inclined at an acute angle to the upper side of the ski, said angle opening toward the tip of the ski, wherein said roller has one of a cylindrical and a frusto-conical shape, and wherein a surface of said roller is a control surface for said cam surface of said lever and the engagement therebetween at any given point in time is a line.

3. The binding according to claim 2, wherein said cam surface of said lever, in said downhill skiing position, rests on a front part of said roller and, in a swivelled position of said lever prior to a release of said locking mechanism, rests on a rear part of said roller.

4. The binding according to claim 2, wherein said roller is frusto-conical, wherein said cam surface of said lever has an angle of inclination which corresponds to the angle of a cone defined by said frusto-conical roller, and wherein said roller is biased axially along said locking bolt in a direction toward said lever by a compression spring which encircles said locking bolt.

5. The binding according to claim 1, wherein said lever includes first and second parts, said first lever part being supported for pivotal movement about said holding axle and having thereon said first locking part, and said second lever part being supported for independent pivotal movement relative to said first lever part and having thereon said second locking part.

6. The binding according to claim 5, wherein said first lever part has a recess therein in which said second lever part is supported for pivotal movement about said holding axle, and wherein said second lever part is resiliently urged to pivot relative to said first lever part by an adjustable compression spring.

7. The binding according to claim 1, wherein said support member has a portion adjacent said base plate which has an opening therethrough, and wherein said abutment is a portion of said base plate which is bent to extend upwardly through said opening in said support member, said locking bolt being secured to said abutment at a location spaced above said portion of said support member.

8. The binding according to claim 7, wherein said locking bolt extends substantially horizontally and said roller thereon is cylindrical.

* * * * *